United States Patent [19]

Taddicken

[11] 4,436,041

[45] Mar. 13, 1984

[54] ATTACHMENT FOR FEEDING REINFORCING BACK BUTTONS TO A SEWING MACHINE

[75] Inventor: Hermann Taddicken, Schwäbisch Gmünd, Fed. Rep. of Germany

[73] Assignee: Eisele Apparate-und Geratebau GmbH, Fed. Rep. of Germany

[21] Appl. No.: 374,474

[22] Filed: May 3, 1982

[30] Foreign Application Priority Data

May 13, 1981 [DE] Fed. Rep. of Germany ... 8114009[U]

[51] Int. Cl.[3] ..... D05B 3/14

[52] U.S. Cl. ..... 112/110; 112/113; 221/156; 221/278

[58] Field of Search ..... 112/110, 111, 112, 113, 112/104; 221/156, 278, 186

[56] References Cited

U.S. PATENT DOCUMENTS

| | | | |
|---|---|---|---|
| 3,157,311 | 11/1964 | Browfman | 221/186 |
| 3,175,703 | 3/1965 | Young, Jr. | 112/113 X |
| 3,390,812 | 7/1968 | Bono | 112/113 X |
| 3,960,094 | 6/1976 | Hsiao | 112/110 |
| 4,327,652 | 5/1982 | Fletcher et al. | 112/110 |

FOREIGN PATENT DOCUMENTS

| | | | |
|---|---|---|---|
| 638299 | 11/1936 | Fed. Rep. of Germany | 112/113 |

*Primary Examiner*—H. Hampton Hunter
*Attorney, Agent, or Firm*—McGlew and Tuttle

[57] ABSTRACT

An attachment for feeding reinforcing back buttons to a sewing machine which has a feed for main buttons to a button clamp which is positioned over a work material which is moved through a sewing station to sew the main button together with the back button which is fed beneath the material comprises a plate member which is mountable on a support arm of the sewing machine over which the material is fed. The attachment includes a plate member over which the material is fed which has a button chute guide groove defined thereon terminating in a button recess having a button aligning stop edge. The back button feed chute is connected to the plate for feeding back buttons in succession into the recess against the aligning stop edge. The guide groove is advantageously machined in an exchangeable plate which may attach to the work support arm of a sewing machine. The construction advantageously includes a compressed air nozzle which opens into the guide channel and is oriented to blow air into a guide channel space directly adjacent to the receiving element. The back button is covered by resilient retaining strips which may be displaced upwardly to permit removal of the button as the receiving workpiece material is moved along through the sewing station.

7 Claims, 3 Drawing Figures

ATTACHMENT FOR FEEDING REINFORCING BACK BUTTONS TO A SEWING MACHINE

FIELD AND BACKGROUND OF THE INVENTION

This invention relates in general to sewing machines and in particular to a new and useful attachment for feeding reinforcing back buttons to a sewing machine which has a feed for main buttons to a button clamp which is positionable over the work material.

Simultaneous sewing of a main button to the upper side and of a back or reinforcing button to the underside of a piece of clothing is known, for example from German Pat. Nos. 668 456 and 699 972. The receiving element for the main button is a liftable button clamp, while a recess in the workplate is provided for the back button. Both buttons must be brought into alignment and placed in the receiving elements by the operator.

In machines of this kind, more than enough space is available for the piece of clothing above the receiving element. That is why automatically operating devices for aligning and feeding the main button have been developed, see for example U.S. Pat. No. 3,157,311 and German Utility Model No. 75 38 335. In the U.S. device, the buttons are directed from a supply receptacle connected to a vibrator, through a chute to a brake which must be released upon lifting the bottom clamp, to clear the feedway and let the leading button in the fed row slide under its own weight into the sewing position determined by the pivotally mounted stop. This, however, can be done only with buttons of a definite shape such as the button provided in the U.S. reference, having an about rectangular extension and thus capable of self-aligning, if the feed channel is adequately designed. In the device disclosed in the German reference, the buttons are brought into their sewing position by means of aligning and feed mechanism.

If a back button is to be sewed simultaneously with the main button in such prior art devices, the back button must still be aligned and put in place in the receiving element manually, because the space beneath the piece of clothing is too limited to allow a mounting of aligning and feeding mechanisms. Losses of time are therefore unavoidable, since the work must be removed whenever a back button is to be inserted. It is not possible either to use time-saving tabulators, by means of which upon every sewing operation, the work is automatically shifted through the spacing between two buttons.

SUMMARY OF THE INVENTION

The invention is directed to eliminating those drawbacks of the prior art and providing an attachment with which even back buttons can be brought into their sewing position automatically.

In accordance with the invention the attachment includes the button chute guide groove defined in a plate which is attachable or positionable over a workpiece support arm of the sewing machine. The plate is positioned below the reciprocating needle of the machine and the material to be worked upon is fed over the plate. The plate has a button chute guide groove defined thereon terminating in a button recess having a button aligning stop edge. A back button feed chute is connected into the groove and provides a feeding of back buttons in succession into the recess. Advantageously, a compressed air supply is employed to insure that the back buttons are fed up to the aligning stop edge of the recess in a position for sewing to the workpiece together with a main button which is positioned thereover in the button clamp. The button in the groove is advantageously covered by one or more resilient strips which hold the button against displacement by the following buttons which are fed by gravity in the button chute. The strips are flexible enough to permit the button to move out of the groove with the workpiece after the sewing is completed.

Accordingly, it is an object of the invention to provide an improved attachment for feeding back buttons to a sewing machine which includes a plate over which the workpiece is fed which has a guide groove for the buttons which terminate in a recess having an aligning edge against which the buttons are fed in succession for each sewing operation.

A further object of the invention is to provide a button attachment for facilitating the feed of an additional button below a workpiece and a sewing machine which has means for clamping a main button over the workpiece for sewing thereon.

A further object of the invention is to provide an attachment for a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
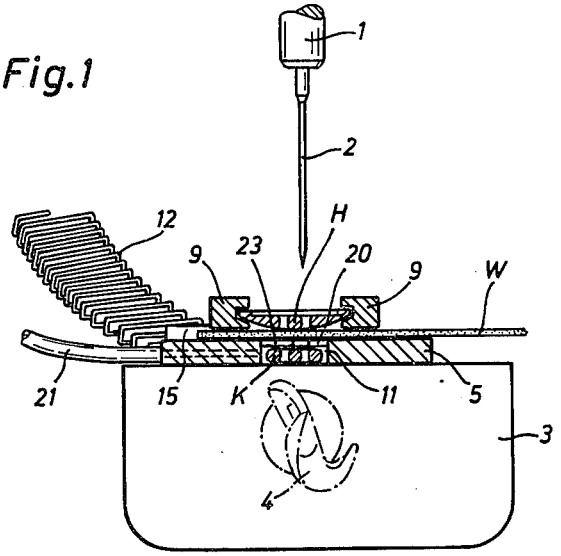
FIG. 1 is a partial front elevational view partly in section of a work supporting arm of a button sewing machine having a back button feed attachment thereon constructed in accordance with the invention.
Figure 2:
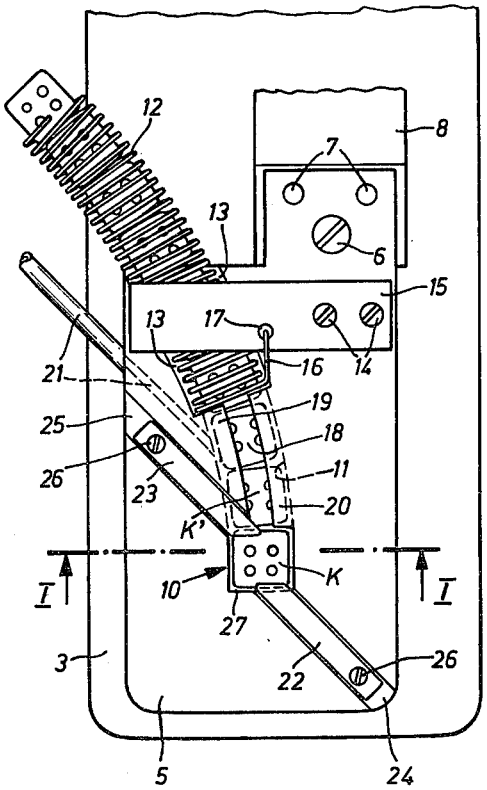
FIG. 2 is a partial top plan view of the device shown in FIG. 1.
Figure 3:
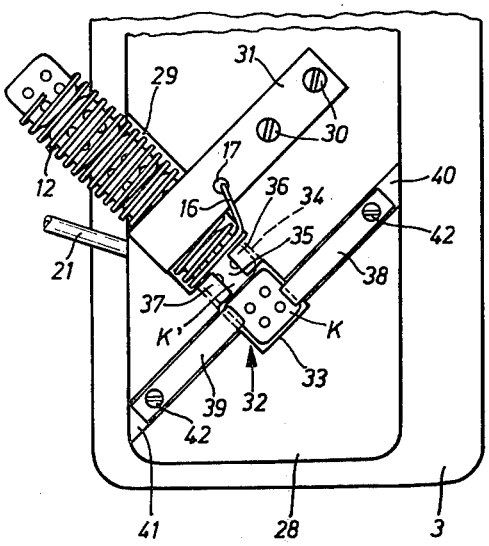
FIG. 3 is a figure similar to FIG. 2 of another embodiment of the invention.

Referring to the drawings in particular the invention embodied therein as shown in FIGS. 1 and 2, comprises an attachment for feeding reinforcing back buttons K to a sewing machine having a reciprocating needle bar 1 carrying a sewing needle 2 which reciprocates over a workpiece support arm 3 having a looper 4 therein which cooperates with the needle to effect the sewing through the workpiece W. In accordance with the invention a plate member 5 is provided over which the workpiece material W is fed which has a button chute guide groove or channel 11 defined therein which terminates in a recess 10 having a button aligning stop edge 27 at the lower end thereof. A back button feed chute 12 is connected to the plate and feeds back buttons K in succession into the recess 10 against the aligning stop edge 27.

The back buttons K to be automatically brought into their position for sewing, have a substantially square shape and four holes. They can be sewed onto a work W, simultaneously with two-hole, four-hole, or even eye-type main buttons on a sewing machine of conventional design, such as Pfaff K1 3306.

Only some elements of the prior art sewing machine are shown, namely the oscillating needle bar 1 carrying a thread guiding needle 2, and a looper 4 mounted in the work supporting arm 3 of the sewing machine and following the oscillatory motion of the needle to cooperate therewith in forming stitches.

A plate 5 fixed to work supporting arm 3 is provided as a rest for a piece of clothing or work W onto which a four-hole button H and a back button K are to be sewed. By a screw 6 and studs 7, plate 5 is secured in position on a control bar 8 which is connected to a control device of a button sewing machine. Control bar 8 further supports the receiving element for main button H, designed as a button clamp 9. Clamp 9 can be supplied with main buttons H by an aligning and feed mechanism known per se and for this purpose, it can be lifted from its operating position into a receiving position. To sew a four-hole main button and a back button to a work, after terminating the first group of stitches through the first pair of holes, control bar 8 and thus plate 5 are shifted through a distance corresponding to the spacing of the two pairs of holes in the main button, into a position for sewing the second group of stitches through the second pair of holes.

In plate 5, a recess 10 is provided serving as the receiving element for back buttons K to be sewed on. Recess 10 communicates through a guide channel 11 with the mouth of a feed chute 12 for back buttons K, which is wound of spring wire and connected by its other end to a button supply receptacle of a vibrator. The mouth end of chute 12 is inserted in an arcuate groove 13 of plate 5 and clamped to plate 5 by means of a pressure strip 15 which is screwed to the plate by screws 14. The free end 16 of the spring wire of chute 12 is bent and engaged in a bore 17 of pressure strip 15. Guide channel 11 is partly covered by projecting webs 19 and 20 leaving a free inspection gap 18.

At a location upstream of the back button K which is received in channel 11 in a standby position directly adjacent recess 10, a line 21 leading from a compressed-air source opens into channel 11, so that an air jet assisting the button feed toward recess 10 may be directed at the next adjacent or standing-by, back button K.

To prevent the back button K already received in recess 10 from being pushed upwardly, out of the recess, by the weight of the buttons following in chute 12, two resilient guard strips 22, 23 are provided which are received in grooves 24, 25 of plate 5 and fixed near their external ends by screws 26. The free end edges of guard strips 22, 23 extend parallel to the stop edge 27 of recess 10, by which the sewing position of back button K received in recess 10 is determined. Stop edge 27 extends parallel to the front edge of plate 5. The free ends of guard strips 22, 23 project over recess 10 to an extent preventing the back button K received in the recess 10 from being pushed upwardly, however, making it possible, after the sewing operation and thread cutting, to remove the button from recess 10 along with the work W, during which removal the guard strips 22 and 23 yield upwardly.

If a two-hole main button is to be sewed along with a back button K, the button sewing machine is set to sew a single stitch group and a plate 28 is substituted for plate 5. The mouth end of chute 12 is disengaged from plate 5 and inserted in a groove 29 of plate 28, extending at about 45° to the front edge of plate 28, and clamped thereto by means of a pressure strip 31 which is fixed to plate 28 by screws 30. Air line 21 also is disengaged from plate 5 and introduced into a bore provided for this purpose in plate 28, and secured therein.

In plate 28, a recess 32 is provided serving as a receiving element for back buttons K and having a stop edge 33 which determines the sewing position of back buttons K and extends at about 45° to the front edge of plate 28. Recess 32 communicates through a guide channel 34 with the mouth of feed chute 12 through which the back buttons K coming from the button supply receptacle of a vibrator are fed into recess 32 under their own weight. Guide channel 34 is partly covered by projecting webs 36, 37 leaving an inspection gap 35.

To prevent a back button K received in recess 32 from being pushed upwardly out of the recess, by the weight of the buttons following in chute 12, two resilient guard strips 38 and 39 are provided which are received in respective grooves 40 and 41 of plate 28 and secured near their ends to plate 28 by screws 42. The free end edges of guards 38 and 39 project over recess 32 to an extent preventing the back button K received in recess 32 from being pushed out upwardly, however, making it possible after the sewing operation and thread cutting, to remove the button from recess 32 along with the work W, during which removal guard strips 38 and 39 yield upwardly.

The device operates as follows:

The individual main buttons H to be sewed on the upper side of a piece of clothing W are fed in by an aligning and feed mechanism known per se (not shown), by which each single button is introduced into the jaws of button clamp 9 to occupy a position in which the holes of the button are aligned with the needle.

The back buttons K,K′ etc. to be sewed onto the underside of the piece of clothing W come from the receptacle of a vibrator and slide or chute 12 by their own weight until they reach recess 10 or 32 and butt against stop edge 27 or 33 determining their sewing position. The feed of every following button K′ into recess 10 or 32, after the thread has been cut and the preceding back button K sewed on has been removed by displacing the piece of clothing W, is assisted by an air jet issuing from line 21 and directed into guide channel 11 or 34. This design ensures that a new back button is repeatedly available in its standby position immediately after the preceding one, already sewn on, has been removed from recess 10 or 32, without the necessity of providing a special expensive equipment. As soon as another main button is fed into button clamp 9 while work W is shifted into its next sewing position and button clamp 9 is lowered again to the work, the button sewing machine can be started to perform the next sewing operation.

As mentioned above, to switch the operation from sewing four-hole main buttons along with back buttons, to sewing two-hole main buttons along with back buttons, plate 28 must be substituted for plate 5. Then, only the mouth end of chute 12 and line 21 are to be disengaged from plate 5 and connected to plate 28, and the button sewing machine is to be correspondingly set.

While specific embodiments of the invention have been shown and described in detail to illustrate the application of the principles of the invention, it will be understood that the invention may be embodied otherwise without departing from such principles.

What is claimed is:

1. An attachment for feeding reinforcing back buttons to a sewing machine having a feed for main buttons to a button clamp which is positionable over the work material which is moved through a sewing station, comprising a plate member over which the material is set having a button chute guide groove defined thereon terminating in a button recess having a button aligning stop edge at the end thereof, and a back button feed chute connected to said plate for feeding back buttons in succession into said recess against said aligning stop edge.

2. An attachment according to claim 1, wherein said plate is exchangeable and has a button aligning stop edge positioned in accordance with the button holes of the particular button which is to be fed so as to align the edge of the buttons in a position so that they will be engaged by the needle of the sewing machine.

3. An attachment according to claim 1, wherein said button chute guide groove is curved, said button chute comprising a wound coil spring having convolutions defining a button feed channel which is engaged in said button chute guide groove.

4. An attachment according to claim 1, including an air line connected to said plate for directing a button moving air stream to each back button to align it against the guide groove and facilitate its feeding.

5. An attachment according to claim 1, including a resilient strip overlying at least a portion of said recess in a position to inhibit removal of the button into the recess until after it is sewed.

6. An attachment according to claim 1, wherein said button aligning stop edge extends transverse to the axis of the work support arm of the sewing machine.

7. An attachment according to claim 1, wherein said button aligning edge extends at an angle to the axis of said support arm.

* * * * *